US011878856B2

(12) United States Patent
Schnakenberg et al.

(10) Patent No.: US 11,878,856 B2
(45) Date of Patent: Jan. 23, 2024

(54) PACKET FOR CIGARETTE INDUSTRY PRODUCTS, AND METHOD FOR PRODUCING SAME

(71) Applicant: Focke & Co. (GmbH & Co. KG), Verden (DE)

(72) Inventors: Jan Schnakenberg, Blender-Amedorf (DE); Johann Köster, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 121 days.

(21) Appl. No.: 17/438,493

(22) PCT Filed: Mar. 9, 2020

(86) PCT No.: PCT/EP2020/056256

§ 371 (c)(1),
(2) Date: Sep. 13, 2021

(87) PCT Pub. No.: WO2020/187634

PCT Pub. Date: Sep. 24, 2020

(65) Prior Publication Data

US 2022/0153509 A1 May 19, 2022

(30) Foreign Application Priority Data

Mar. 15, 2019 (DE) ..... 102019106620.4

(51) Int. Cl.

| | |
|---|---|
| ***B65D 85/10*** | (2006.01) |
| ***B65B 19/22*** | (2006.01) |
| ***B65D 65/42*** | (2006.01) |

(52) U.S. Cl.
CPC ..... *B65D 85/10568* (2020.05); *B65B 19/22* (2013.01); *B65D 65/42* (2013.01)

(58) Field of Classification Search
CPC .. B65D 85/10568; B65D 85/10; B65D 85/00; B65D 65/42; B65B 19/22
(Continued)

(56) References Cited

U.S. PATENT DOCUMENTS

| | | | |
|---|---|---|---|
| 3,948,389 | A | 4/1976 | Molins |
| 4,293,068 | A | 10/1981 | Focke |

(Continued)

FOREIGN PATENT DOCUMENTS

| | | | |
|---|---|---|---|
| CN | 107458686 | A | 12/2017 |
| DE | 2420110 | A | 11/1974 |

(Continued)

OTHER PUBLICATIONS

WIPO, International Search Report (in a related application), dated May 27, 2020.

(Continued)

*Primary Examiner* — Rafael A Ortiz
(74) *Attorney, Agent, or Firm* — Laurence P. Colton; SMITH TEMPEL BLAHA LLC

(57) ABSTRACT

A packet for cigarette industry products, having a casing which at least partially surrounds a group of cigarette industry products as the packet content, wherein the casing is formed from a packaging material, and wherein folding tabs of the packaging material are connected to one another by seams, in which the casing is formed from a paper-based packaging material, and a corresponding method.

28 Claims, 9 Drawing Sheets

(58) Field of Classification Search
USPC ..... 206/268, 274, 271, 273
See application file for complete search history.

(56) References Cited

U.S. PATENT DOCUMENTS

| | | | | |
|---|---|---|---|---|
| 8,123,030 | B2 | 2/2012 | Focke | |
| 2008/0308432 | A1* | 12/2008 | Lutzig | B65D 65/14 206/265 |
| 2010/0038266 | A1* | 2/2010 | Hallstrom | B32B 27/32 428/313.5 |
| 2018/0334316 | A1* | 11/2018 | Buse | B65D 85/10568 |

FOREIGN PATENT DOCUMENTS

| | | | | |
|---|---|---|---|---|
| DE | 2847161 | A1 | 5/1980 | |
| DE | 102008035467 | A1 | 2/2010 | |
| DE | 102015110682 | A1 | 1/2017 | |
| DE | 102016114350 | A1 * | 2/2018 | B65B 19/025 |
| DE | 102016114350 | A1 | 2/2018 | |
| DE | 102016012300 | A1 | 4/2018 | |
| DE | 102016118581 | A1 | 4/2018 | |
| WO | WO-2016087829 | A1 * | 6/2016 | B65D 75/5838 |
| WO | 2016132379 | | 8/2016 | |
| WO | WO-2017072730 | A1 * | 5/2017 | |
| WO | 2018072863 | A1 | 4/2018 | |
| WO | 2018091398 | A1 | 5/2018 | |
| WO | 2018154508 | A1 | 8/2018 | |
| WO | 2018197880 | A1 | 11/2018 | |
| WO | WO-2018210832 | A1 * | 11/2018 | A24F 15/12 |

OTHER PUBLICATIONS

Deutsches Patent-Und Markenamt (German Patent and Trademark Office), Recherchebericht (search in a related application), Nov. 27, 2019.

* cited by examiner

PACKET FOR CIGARETTE INDUSTRY PRODUCTS, AND METHOD FOR PRODUCING SAME

CROSS REFERENCE TO RELATED APPLICATIONS

This application is the US National Phase of and claims the benefit of and priority on International Application No. PCT/EP2020/056256 having a filing date of 9 Mar. 2020, which claims priority on and the benefit of German Patent Application No. 10 2019 106 620.4 having a filing date of 15 Mar. 2019.

BACKGROUND OF THE INVENTION

Technical Field

The invention relates to a packet for cigarette industry products, having a casing which at least partially surrounds a group of cigarette industry products as the packet content, wherein the casing is formed from a packaging material, and wherein folding tabs of the packaging material are connected to one another by seams.

The invention furthermore relates to a method for producing packets for cigarette industry products, in particular as claimed in one or a plurality of the preceding claims, wherein a group of cigarette industry products as the packet content is at least partially encased in a packaging material, and wherein folding tabs of the packaging material for closing the casing of packaging material thus formed are connected to one another by forming seams.

Prior Art

Known in practice is the production of packets of cigarettes, wherein a cigarette group is disposed in a casing from a sealing-capable fill material based on plastics material, and the filler material is closed by forming seams so as to achieve a so-called tight block in which the cigarettes can be securely stored. It is known here for the seams to be formed or closed, respectively, by sealing plies of the film material. It is furthermore known that the seams can be sealed in the relation to the cigarette group by sealing overlapping folding tabs of the film material, or as so-called fin seams, without the pressure on the mutually overlapping plies of the film material required for sealing acting on the cigarette group.

Packets of this type have been fundamentally successful. In some markets or countries, respectively, there are however provisions which regulate the types of material with which the cigarettes as the packet content may come into contact. In such countries it is in particular not permitted that the cigarettes may come into contact with coated materials and/or sealing media (for example varnishes, glues, adhesives, etc.). The use of the known packets of the type mentioned at the outset is thus not possible or possible only to a limited extent in such countries.

BRIEF SUMMARY OF THE INVENTION

Proceeding therefrom, the invention is based on the object of refining packets of the type mentioned at the outset, in particular with a view to at least partially eliminating the problems present in the prior art, but at least with a view to achieving further embodiments. The invention is furthermore based on the object of proposing a suitable method for producing packets of this type.

A packet according to the invention is a packet for cigarette industry products, having a casing which at least partially surrounds a group of cigarette industry products as the packet content, wherein the casing is formed from a packaging material, and wherein folding tabs of the packaging material are connected to one another by seams, characterized in that the casing is formed from a paper-based packaging material. It is accordingly provided that the casing is formed from a paper-based packaging material.

In comparison to the prior art, this solution has the advantage that the paper-based casing is easier to recycle than the known casings based on plastics material.

A paper-based packaging material in the context of this application is understood to be a material which is at least partially composed of paper. In a multi-ply or multi-layer construction, respectively, at least one ply or layer can be at least partially composed of paper. In a single-ply construction, the packaging material, or the at least one ply or layer, respectively, can correspondingly be at least partially composed of paper. The ply or layer, respectively, is preferably largely or completely composed of paper. Material mixtures for the ply or the layer having a proportion of paper, preferably a large proportion of paper, are also conceivable. The packaging material preferably has an ideally minor proportion of plastics material. Potential coatings of the packaging material such as, for example, varnishes, adhesives, ink or the like, are not taken into account in this consideration, thus are not part of the construction of the packaging material per se.

It can furthermore be provided that the group of products is disposed in a tray of packaging material, and that the casing surrounds the group of products and the tray.

It is preferably provided that the casing has a large-area front side, a corresponding, opposite, large-area rear side, narrow sides that connect the front side and the rear side to one another, as well as a base side and an opposite end side, wherein the base side and the end side are in each case adjacent to the front side, the rear side and the narrow sides.

It can furthermore be provided that the casing has a retrieval opening, able to be closed by a closure means that is able to be activated multiple times, wherein the closure means is paper-based.

The paper-based closure means can extend across an end side of the casing and substantially cover the end side. Alternatively, it is conceivable that the closure means has a width smaller than the end side of the packet, and does not cover the end side on one side or both sides in the transition to one narrow side or both narrow sides.

It can furthermore be provided that the folding tabs of the paper-based packaging material in the region of the seams are connected to one another in a materially integral manner.

In one preferred embodiment it can be provided that the group of products, as the inner pack surrounded by the casing from a paper-based packaging material, is disposed in an outer pack, in particular in an outer pack of the hinge-lid type.

In one preferred embodiment it can furthermore be provided that the seams of the casing from a paper-based packaging material are configured as fin seams.

It can furthermore be provided that the packaging material has a paper base having a grammage of 30 to 140 g/m$^2$, particularly having a grammage of 30 to 90 g/m$^2$, most preferably 30 to 70 g/m$^2$.

A further particularity can lie in that the paper-based packaging material has a unilateral coating having a material for connecting the folding tabs in a materially integral manner in the region of the seams. The coating is preferably provided only in the region of the folding tabs to be connected.

The coating can be formed from one or a plurality of the following materials:

hot-melt glue;

cold glue or a dispersion adhesive, respectively;

PSA (pressure sensitive adhesive);

sealing varnish, in particular a polymer-based sealing varnish.

In one preferred embodiment it can be provided that the casing has seams, in particular longitudinal seams, which run so as to be directed parallel to the longitudinal axis of the casing, and that the casing has seams, in particular transverse seams, which run so as to be directed transversely to the longitudinal axis of the casing.

It can furthermore be provided that seams of the casing, in particular transverse seams and/or longitudinal seams, are folded toward neighboring lateral faces of the casing and thereon are fastened to the casing by adhesive bonding.

It can furthermore be provided that seams, in particular longitudinal seams, in the region of the narrow sides of the casing are folded in the direction of a front side or a rear side of the casing.

It can preferably be provided that in casings having seams that are folded in the direction of the front side, the packet in the region of the narrow sides of the casing does not have any collar, and the folded seams are fastened to the casing by adhesive bonding, in particular so as to avoid any collision between a lid of the packet and the folded seams when closing the lid of the packet.

A particularity can lie in that the packaging material on a side that faces away from the packet content has a coating as a vapor barrier, in particular a coating from a wax-type material or from aluminum.

In one preferred embodiment it can be provided that the packet has two fin seams in the region of the narrow sides of the packet, as well as a fin seam of the front side or rear side which is directed transversely to the fin seams in the region of the narrow sides.

It can preferably be provided that the group is disposed in a tray, and that the casing, in particular in the region of the retrieval opening, only partially encases the group having the tray, and that the region of the group not encased by the casing is encased (across the full area) by the tray.

It can furthermore be provided that the casing is connected to the tray in a materially integral manner, in particular in the transition between a lower end of the casing.

It can also be provided that seams, in particular in the region of the narrow sides, are configured as an envelope fold, wherein the mutually overlapping folding tabs of the packaging material in the region of the seams are connected to one another in a materially integral manner.

A further particularity can lie in that seams in the region of the narrow sides are configured as an envelope fold, and seams in the region of other sides are configured as a fin seam, in particular in the region of the front side, the rear side or the base side.

It can preferably be provided that the closure means is connected to a lid of the outer packet such that the closure means when opening the lid is automatically opened in a corresponding manner in order to expose the retrieval opening, and that the closure means when closing the lead is automatically closed in a corresponding manner.

A method according to the invention is a method for producing packets for cigarette industry products, wherein a group of cigarette industry products as the packet content is at least partially encased in a packaging material, and wherein folding tabs of the packaging material for closing the casing of packaging material thus formed are connected to one another by forming seams, characterized in that the casing is formed from a paper-based packaging material, wherein the folding tabs of the paper-based packaging material in the region of the seams are connected to one another in a materially integral manner. Accordingly, it is provided that the casing is formed from a paper-based packaging material, wherein the folding tabs of the paper-based packaging material in the region of the seams are connected to one another in a materially integral manner.

It can furthermore be provided that a unilateral coating having a material for connecting the folding tabs in a materially integral manner in the region of the seams is applied to the paper-based packaging material.

The coating is preferably applied only in the region of the folding tabs to be connected.

In one preferred embodiment it can be provided that the coating is formed from one or a plurality of the following materials:

hot-melt glue;

cold glue or a dispersion adhesive, respectively;

PSA (pressure sensitive adhesive);

sealing varnish, in particular a polymer-based sealing varnish.

It can preferably be provided that the coating is applied in one or a plurality of the following patterns (to the folding tabs to be connected):

punctiform, striped, partial area, full area.

It can furthermore be provided that the coating for connecting the folding tabs in a materially integral manner in the region of the seams is activated by one or a plurality of the following treatments:

activating the glue or adhesive by means of pressure;

reactivating the hot glue by means of heat.

A particularity can lie in that the paper-based packaging material is provided with one or a plurality of coatings in the production process of the packet.

It is conceivable that the coating for connecting the folding tabs in a materially integral manner in the region of the seams is applied in the production process of the packet.

It is furthermore conceivable that a coating as a vapor barrier, in particular a coating from a wax-type material or from aluminum, is applied to the packaging material on a side that faces away from the packet content in the production process of the packet.

It is furthermore conceivable that a coating is applied to the packaging material in the production process of the packet, non-adhesive regions being defined by way of said coating, in particular by applying a silicone-based coating or an acrylic sealing varnish.

It is furthermore conceivable that a coating for the design of the inner packet is applied to the paper-based packaging material in the production process of the packet.

It is preferably provided that the applied coatings in the production process of the packet are treated in a drying unit.

It can furthermore be provided that the paper-based packaging material in the production process of the packet is subjected to preheating.

Further preferred particulars and details of the invention are derived from the drawings and the description hereunder.

BRIEF DESCRIPTION OF THE DRAWINGS

Preferred exemplary embodiments of the invention will be described hereunder by means of the drawings in which.

DETAILED DESCRIPTION OF PREFERRED EMBODIMENTS

The invention will be explained hereunder by means of packets 10 for cigarettes 11. It is understood that the packets 10 are also suitable for other cigarette industry products.

Cigarette industry products in the context of the application are also understood to be tobacco products such as cigarettes, cigarillos and the like, but also novel tobacco products such as, for example, heat-not-burn products or liquid carriers for e-cigarettes.

Figure 2:
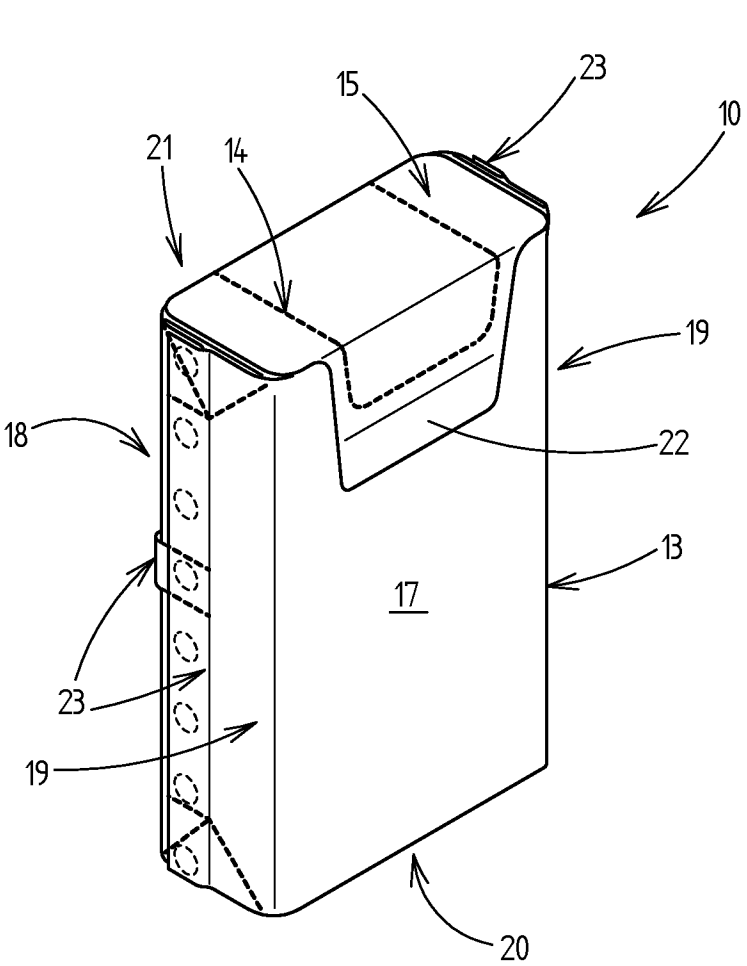
FIG. 2 shows a group of cigarettes in a casing.
Figure 1:
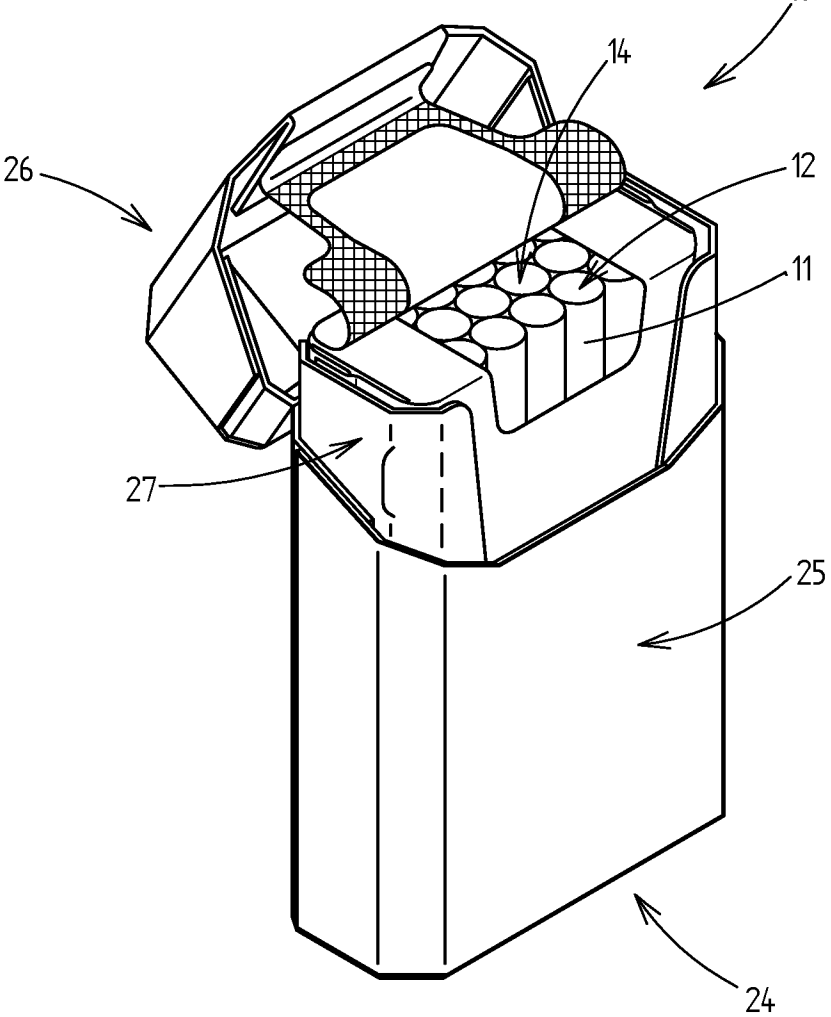
FIG. 1 shows a first packet for cigarettes, having an opened lid.

In the packet 10 shown in FIGS. 1 and 2, a group 12 of cigarettes 11 is provided as the packet content. The group 12 is encased in a casing 13 from a packaging material. A retrieval opening 14 is able to be closed by a closure means 15 which is able to be activated multiple times.

This inner packet 16, or the casing 13, respectively, possesses a large-area front side 17, a corresponding, opposite, large-area rear side 18, as well as narrow sides 19 that connect the front side 17 and the rear side 18 to one another. Furthermore provided is a base side 20 and an end side 21 which are in each case adjacent to the front side 18, the rear side 18 and the narrow sides 19.

The closure means 15 extends substantially across the entire end side 21 and by way of an end region is fastened to the rear side 18. Another end of the closure means 15 extends into the region of the front side 17. The closure means 15 covers the retrieval opening 14 on all sides. A folding tab 22 which serves for opening the closure means 15 is provided at a lower end of the closure means 15.

In the production of the packet 10, the casing 13 is wrapped about the group 12 and closed in a tight manner by forming seams 23, so as to form a so-called tight block. As usual, a plurality of plies of the packaging material are connected to one another here.

In the present case it is provided that folding tabs of the packaging material in the region of the two narrow sides 19 are brought to bear on one another and connected to one another by a seam 23 in the overlap region. This takes place in an analogous manner in the region of the rear side 18 of the casing 13.

FIG. 2 shows that the seams 23 in the region of the narrow sides 19, upon connecting the folding tabs of the packaging material, are folded and placed against the narrow sides 19, wherein the seams 23 are folded in the direction of the rear side 18.

A closed casing 13 in which the packet content is protected from harmful influences is formed by the seams 23. In the region of the retrieval opening 14, the casing 13 is closed by the closure means 15.

The inner packet 16, or the casing 13, according to FIG. 2 can find a receptacle in an outer packet 24 according to FIG. 1. The outer packet 24 in the present case is configured as a hinge-lid packet, having a boxed part 25 and a lid 26 which is pivotably disposed on the latter. The outer packet 24 can furthermore have a collar 27.

Of course, it can also be provided that the outer packet 24 has a different construction. It is also conceivable for the outer packet 24 to be absent. In this case, the terms packet 10, casing 13 and inner packet 16 are to be used synonymously.

In order for the closure means 15 of the inner packet 16 to be opened, the folding tab 22 is fastened to an internal side of a front wall of the lid 26, for example by adhesive bonding. In this way, the closure means 15 is automatically opened when opening the lid 26, and automatically closed when closing the lid 26. Alternatively, it is conceivable, for example, that the closure means 15 of the inner packet 16 is manually opened and closed, for example by gripping the folding tab 22 by the consumer.

A particularity lies in that the closure means 15 is composed of paper and on the lower side is provided with an adhesive layer in order for the retrieval opening 14 to be closed. A PSA (pressure sensitive adhesive) which has a reduced adhesive force (type RC13) of the UPM Raflatac company can be used here, for example.

A further particularity of the closure means 15 from paper can lie in that said closure means 15 extends substantially across the entire end side 21, preferably across the full area of the entire end side 21.

Figure 5:
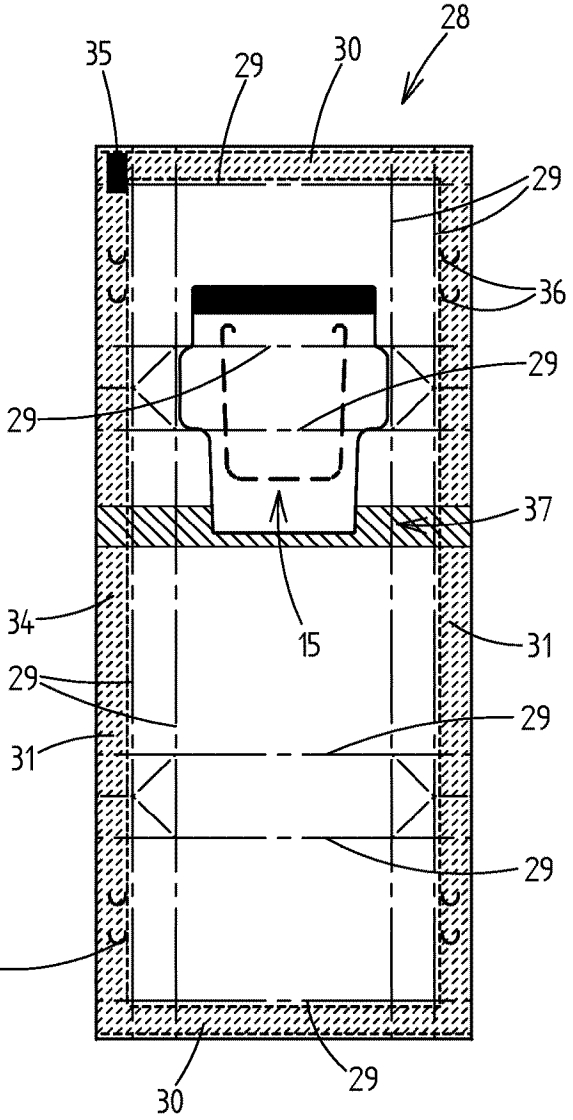
FIG. 5 shows a third blank for the casing.
Figure 4:
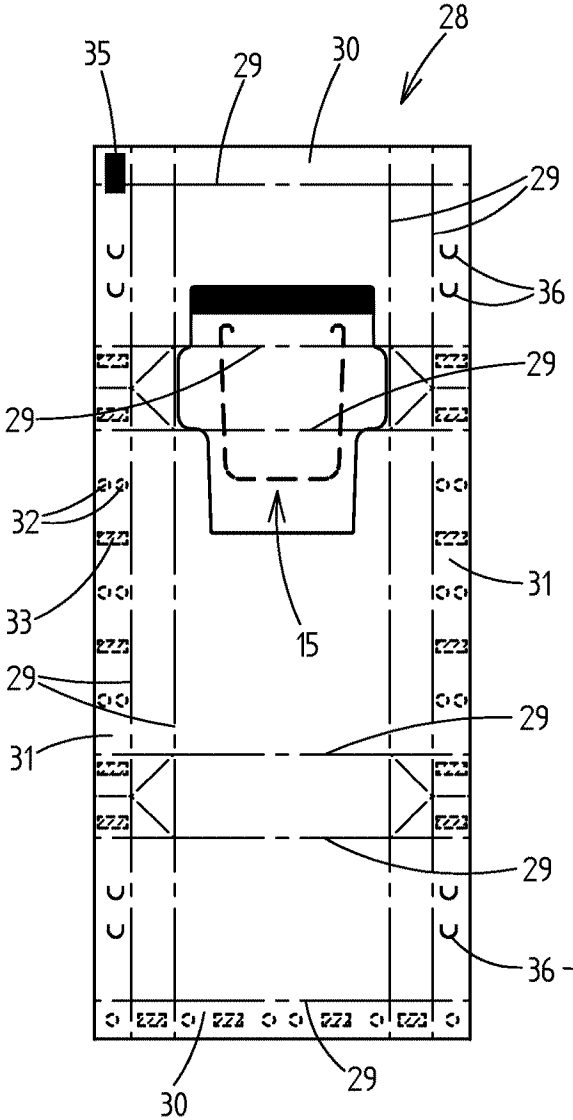
FIG. 4 shows a second blank for the casing.
Figure 3:
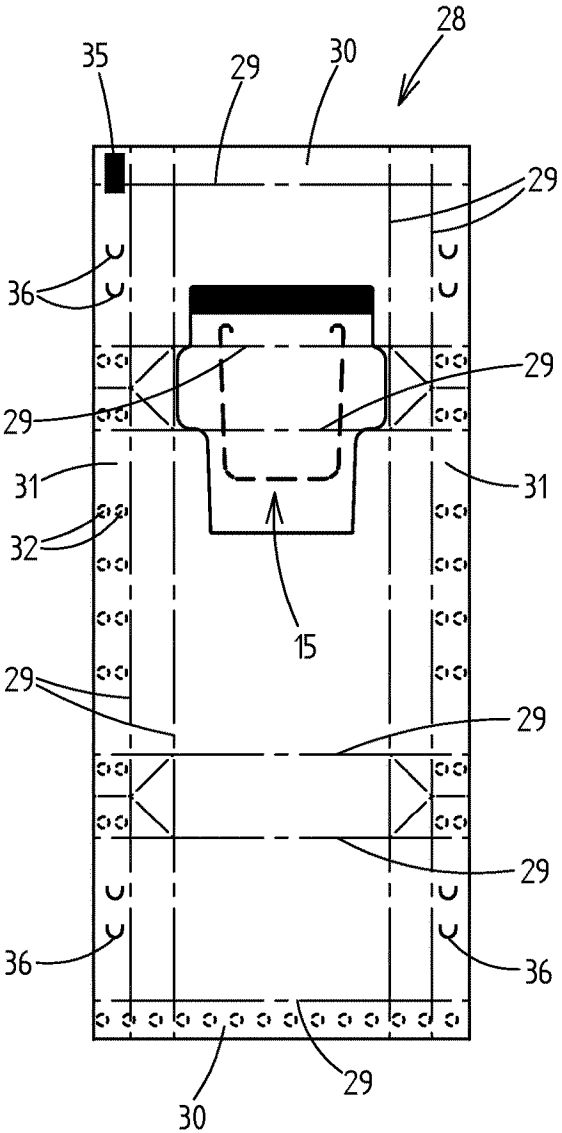
FIG. 3 shows a first blank for the casing.

FIGS. 3 to 5 show three blanks 28 for casings 13 in a spread-out, unfolded state. The regions of the blank for the individual lateral faces of the casing 13 are mutually delimited by fold lines 29. End-side folding tabs 30 for the transverse seams are situated on the periphery, and folding tabs 31 for the longitudinal seams are situated on the longitudinal side, wherein the transverse seam and the longitudinal seams are in each case configured as fin seams.

FIGS. 3 to 5 furthermore show the disposal of coatings of cold glue 32, hot glue 33, and sealing varnish 34. It is illustrated in an exemplary manner that the cold glue 32 is applied to the folding tabs 30 or 31, respectively, to be connected in a punctiform manner, the hot glue 33 on a partial area, and the sealing varnish 34 on a full area. The coatings for connecting the folding tabs 30, 31 are unilaterally applied to the blanks 28, specifically to an internal side (so as to point toward the packet content).

FIGS. 3 to 5 furthermore show the position of an imprint 35, as well as the position of the ventilation flaps 36. The blank 28 according to FIG. 5 furthermore has a silicone coating 37 in the region of the folding tab 22. The silicone coating 37 is applied to the external side and serves as a passivator (deadener) for the adhesive layer of the closure means.

It is understood that the application patterns of the coatings described above are to be understood to be purely exemplary and that other application patterns or coating patterns may also be used, for example the materials mentioned at the outset.

Figure 6:
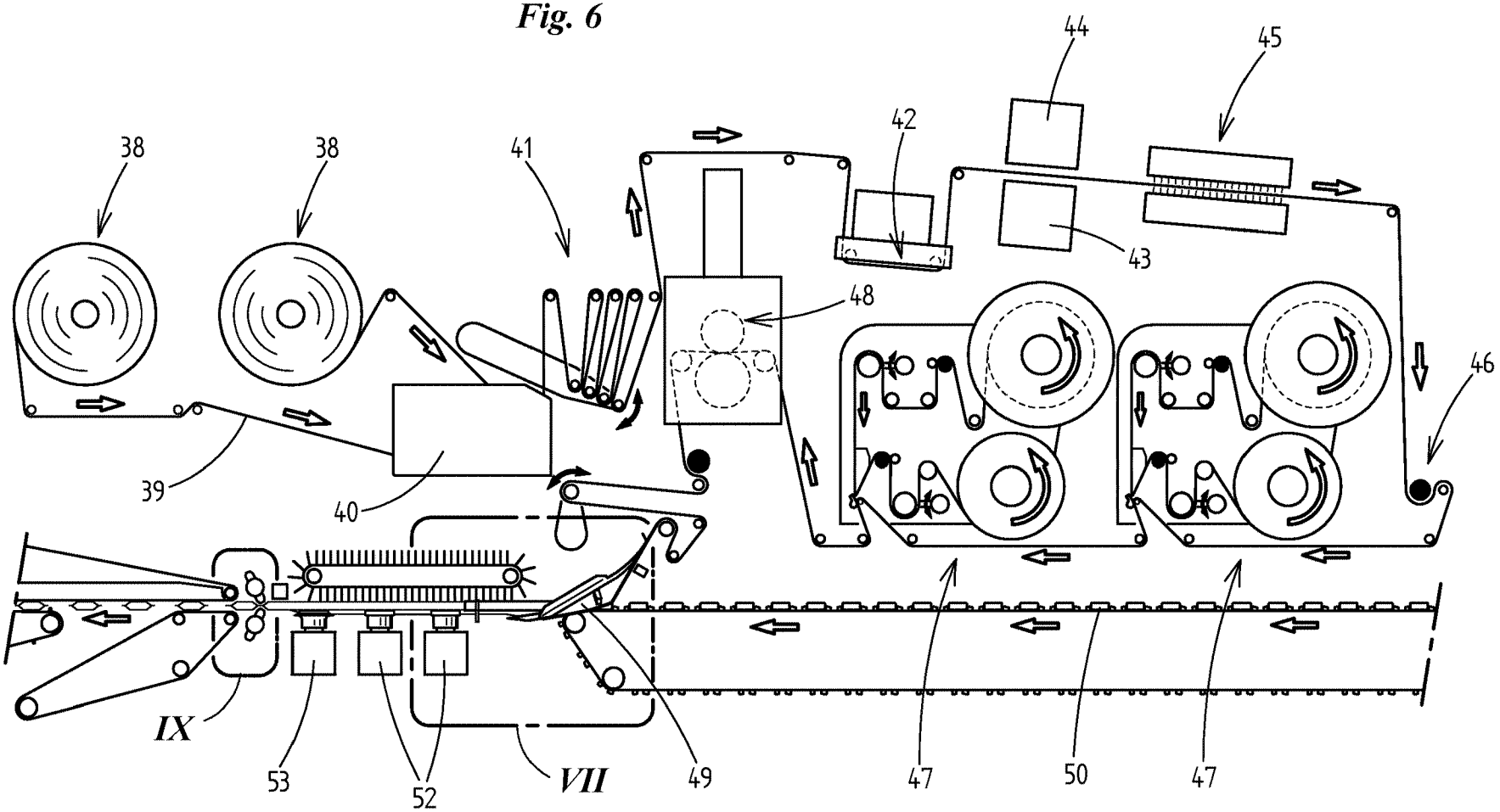
FIG. 6 shows a schematic lateral view of a device for producing the packet.

FIG. 6 shows a conceivable construction of a device for producing the inner packet 16. A material web 39 is drawn off from bobbins 38 and guided through a splicer 40. From the latter, the material web 39 runs through a pendulum accumulator 41. The latter is adjoined by a web edge control 42.

Printing units 43, 44 by way of which the material web 39 can be treated in the process are provided along the further conveying section on both sides of the material web 39. A printing unit 43 below the material web 39 in the present case serves for coating and/or printing the material web 39. (Decorative) printing of the external side of the material web 39 and/or the application of the silicone coating 37 are/is conceivable, for example. A printing unit 44 by way of which the adhesive 32, 33 or the sealing varnish 34 for connecting the folding tabs is applied is provided on the other side of the material web 39. It is also conceivable that the printing unit 44 is used for printing the internal side of the material web 39, for example for printing that side of the material web 39 that faces the packet content.

It is understood that the printing unit(s) 43, 44 can be composed of one or a plurality of printing units. It is also understood that printing units 43, 44 can be disposed on either of the two sides of the material web 39, depending on the design of the internal packet 16.

Downstream of the printing units 43, 44 the coated material web 39 runs through a drying unit 45. The drying unit 45 serves for drying that the applied coatings and can preferably operate on the UV principle.

The material web 39 which to this extent has been prepared in the production process is subsequently transported by an advancing roller 46 into the region of two labelling apparatuses 47, wherein the material web 39 is provided with the closure means 15. It is conceivable that a different number of labelling apparatuses 47 may also be provided.

Thereafter, the material web 39 provided with the closure means 15 is guided by a punching apparatus 48, where punches can be applied to the material web 39 for forming the retrieval openings 14 and/or the ventilation flaps 36.

Thereafter, the running material web 39 makes its way into the region of a forming shoulder 49 across which said material web 39 is guided so as to form a tube about the infed packet content.

The group 12 of cigarettes 11 here is disposed in a tray 50 from package material, wherein the tray 50 surrounds the group 12 on a plurality of sides. The tray 50 can be formed from a stiff packaging material such as thick paper or cardboard.

The groups 12 having the tray 50 are transported by way of a longitudinal extent that is transverse to the transport direction according to the arrow 51 and encased in a tubular manner in a material web 39 from the packaging material. The individual groups 12 having the tray 50 are disposed so as to be mutually spaced apart within the tube of the material web 39. A continuous seam 23 which extends parallel to the transport direction according to the arrow 51 and runs in the region of the later rear side 18 of the inner packet 16 is then formed. This seam 23 hereunder is also referred to as the transverse seam because said seam 23 extends transversely to the longitudinal extent of the inner packet 16.

In order for the transverse seam to be formed, contact pressure or sealing tools 52, respectively, which in principle are known from the prior art are disposed below the packaging web. Furthermore provided are tools 53 which serve for turning the transverse seam against the casing 13. A contact pressure element 54 which presses the material web 39 against the groups 12 or trace 50, respectively, and herein smooths the material web 39 is provided above the packaging web.

Figure 7:
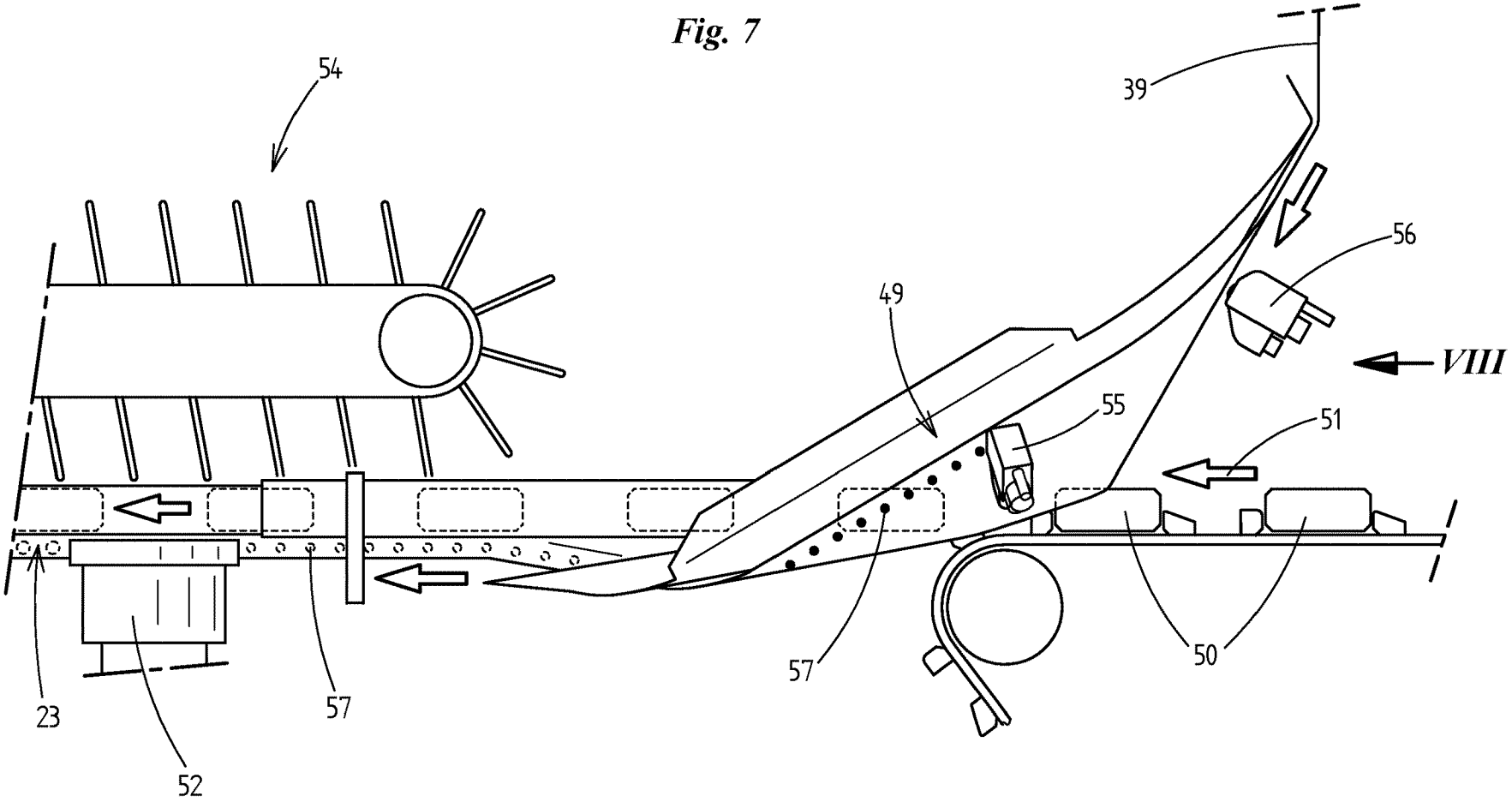
FIG. 7 shows a detail of the device in the region VII in FIG. 6, in an enlarged illustration.
Figure 8:
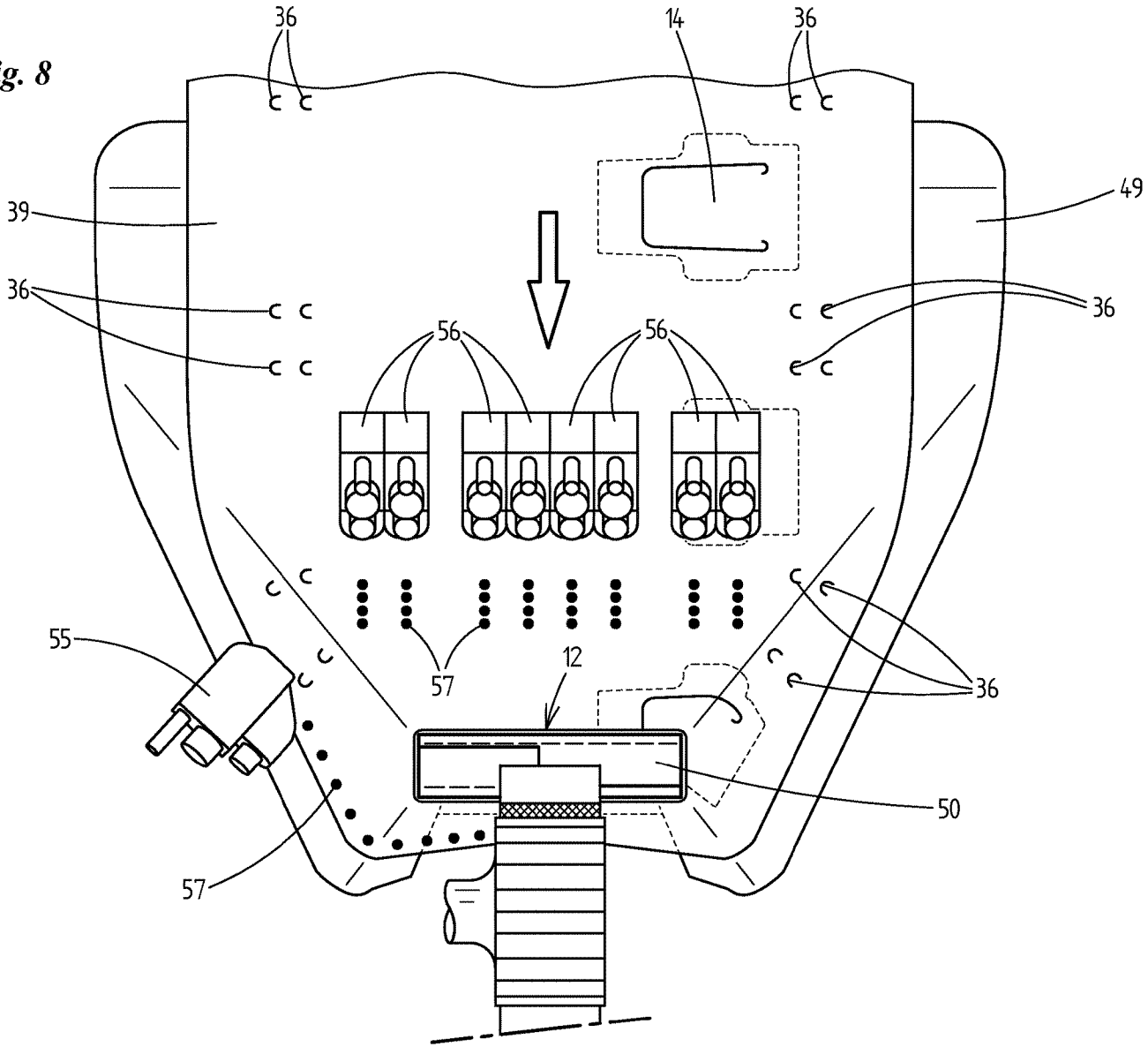
FIG. 8 shows a lateral view of the particular in the viewing direction of the arrow VII in FIG. 7.

FIG. 7 shows the in feeding of the groups 13 in the tray 50 along the packaging web in a larger scale, and the encasing of the groups 13 in the tray 50 in the running material web 39 in the region of the forming shoulder 49. Furthermore shown are gluing apparatuses 55, 56 which serve for applying glue points 57 for the connection of the folding tabs. Gluing apparatuses 55 here serve for applying glue for the folding tabs 31 for the longitudinal seam, and glue apparatuses 56 serve for applying glue for the folding tabs 30 for the transverse seam. FIG. 8 shows the disposal of the gluing apparatuses 55, 56 in detail. The gluing apparatuses 55 are disposed in a plurality of groups in one row, and the gluing apparatuses 56 are disposed on the periphery of the material web 39.

In the next step, the material web 39 is split up between the individual groups 12, singularizing thus being carried out. Seams 23 which run so as to be directed transversely to the transport direction according to the arrow 51 are also formed here. These seams 23 are located in the region of the narrow sides 19 of the inner packet 16 and are also referred to as longitudinal seams because the extent of the latter runs so as to be directed parallel to the longitudinal axis of the inner packets 16.

Figure 9:
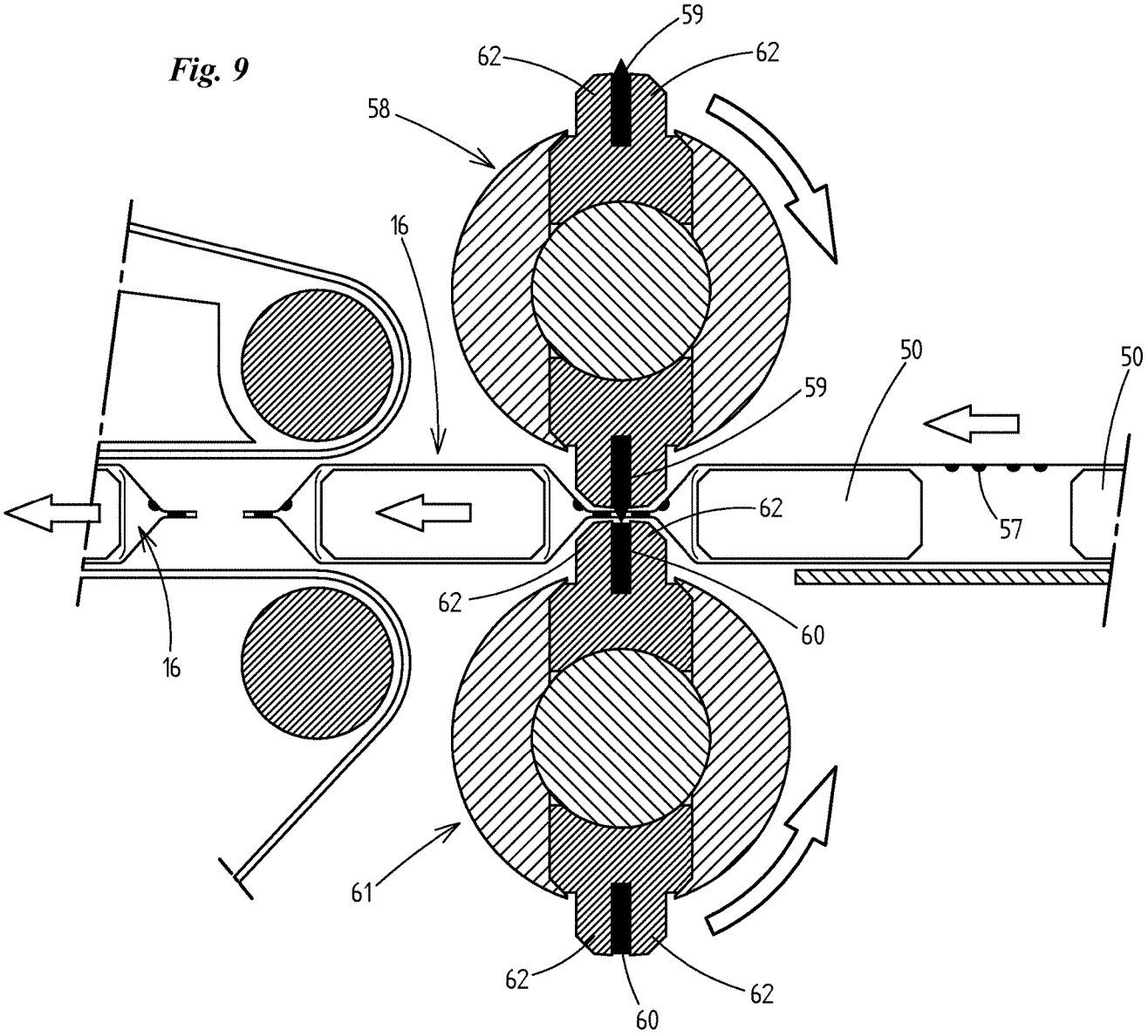
FIG. 9 shows a detail of the device in the region IX in FIG. 6, in an enlarged illustration.

FIG. 9 shows the singularization of the inner packet 16. Rotating rollers are disposed on both sides of the packaging web here. A first roller 58 possesses separating blades 59 which are disposed on the circumference of the roller 58 and collaborate with a counterpart 60 on the counter roller 61 so as to split up the packaging material between the groups 12. The counterpart 60 on the counter roller 61 can be configured like the separating blades 59 or else as a simple block on which the separating blades 59 comes to bear in order for the packaging material to be severed.

Transverse contact pressure elements or transverse sealing elements 62, respectively, by way of which the seams 23 are configured, are configured on both sides of the separating blades 59 or of the counterpart 60, respectively.

With the aid of the device, an inner packet 16 can be produced from a paper-based packaging material. The packaging material can be pure paper or else coated paper, for example having an inner ply from paper and a coating, or outer ply, respectively, from a wax-type material or aluminum. The variants described at the outset are furthermore conceivable. An application of color on the internal side or the external side, both on the full area as well is in regions, is also conceivable. The connection of the folding tabs in the region of the seams 23 can be established by glue or by other sealing media. The glue patterns and glue types may vary. Tools matching the glue are used for connecting the folding tabs.

To the extent that closure means 15 from paper are also used, the inner packet 16 overall can be configured so as to be free of plastics material.

Alternatively to the application of glue, the use of a pre-coated material web 39 from paper is also conceivable, said pre-coated material web 39 being provided (in-line) in the packaging process. By means of digital printing units, for example by the Xaar company (UV printing units XAAR1002/XAAR1003U, inkjet printing systems, piezo printing heads Xaar5601 or Xaar Print Bar System) or by other manufacturers the coating can be applied to the full area or directly after of the web edge control 42. The following options are in particular conceivable:

- an application of sealing varnish on the internal side for connecting the seams 23;
- an application of paint on the external side or the internal side for printing the material web 39;
- an application of a silicone layer 37 on the external side in the region of the folding tab 22 of the closure means 15.

The applied coatings (colored sealing varnish or silicone layer, respectively) can be cured using the drying unit 45. The closure means 15 are attached thereafter, and the material web 39 above the forming shoulder 49 is shaped so as to form a tube and closed using corresponding contact pressure or sealing tools 52, respectively. Additional preheating of the material web 39 for assisting the sealing tools 52 can be provided, for example ahead of the transverse sealing tools on the material web 39 or by a heated forming shoulder 49.

Figure 11:
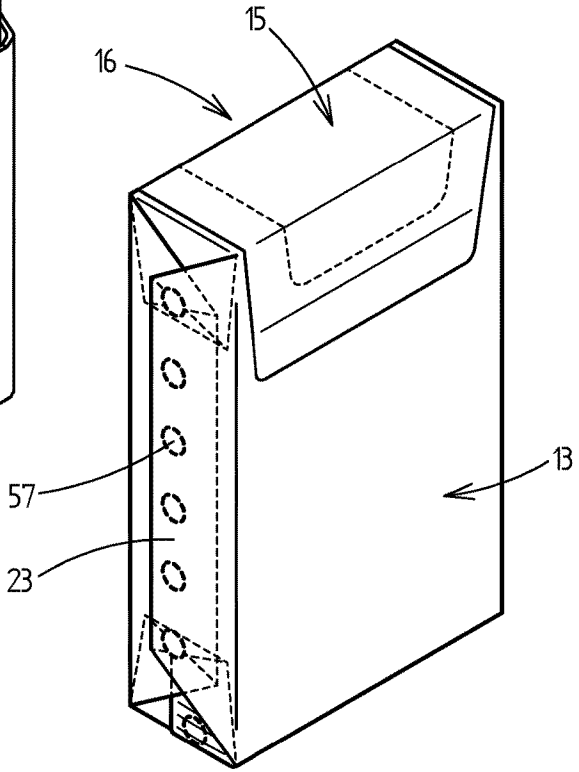
FIG. 11 shows a group of cigarettes in a second casing.
Figure 10:
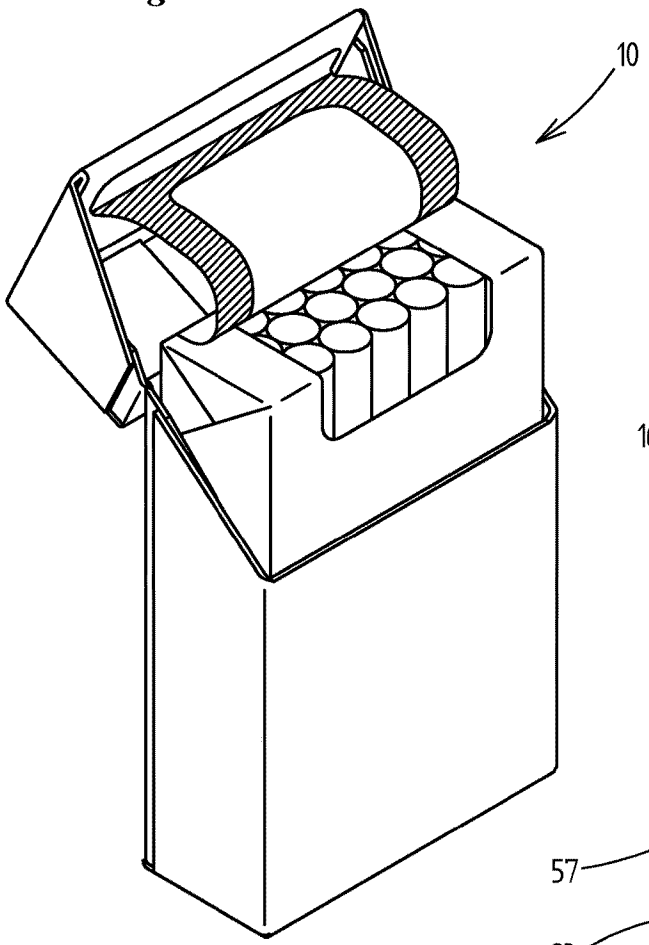
FIG. 10 shows a second packet for cigarettes, having an opened lid.

FIGS. 10 and 11 show a variant of the first exemplary embodiment of the packet 10. The casing 13 and the closure means 15 here are formed substantially as in the case of the first exemplary embodiment; however the seams 23 in the region of the narrow sides 19 are configured as envelope folds. The transverse seam is disposed in the region of the base side 20 and not in the region of the rear side 18, said transverse seam however being a fin seam as in the first exemplary embodiment.

Figure 12:
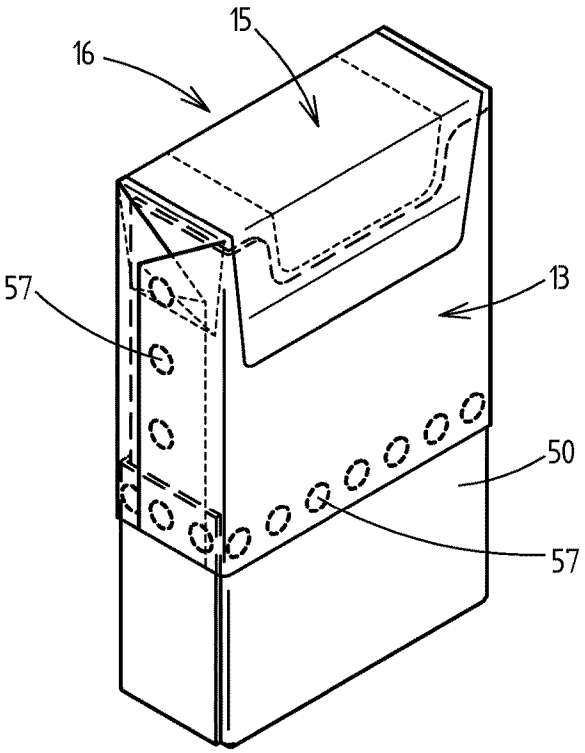
FIG. 12 shows a group of cigarettes in a third (partial) casing.

FIG. 12 shows a cost-effective alternative to the solution according to FIG. 11, specifically having a partial casing 13 which, proceeding from the end side 21, extends along the narrow sides 19, the rear side 18 and the front side 17 but terminates at a spacing from the base side 20. Provided instead of a transverse seam for closing the casing 13 is a glue connection between the tray 50 and the lower periphery of the casing 13.

By the way, all variants shown in FIGS. 10 to 12 dispense with a collar 27, as opposed to the first exemplary embodiment. Instead, the casings 13 contain a tray 50 which assumes the role of the collar 27 and contributes toward stabilizing the lid 26 when closing.

Figure 14:
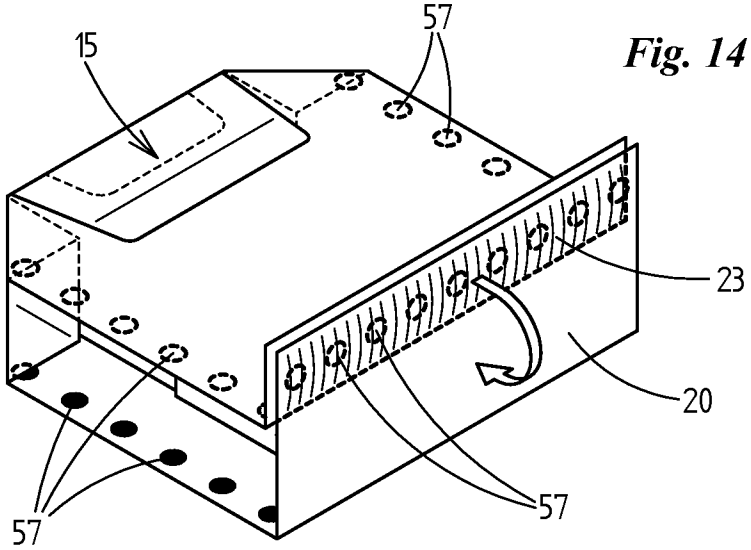
FIG. 14 shows a second step when encasing a group in a blank.
Figure 15:
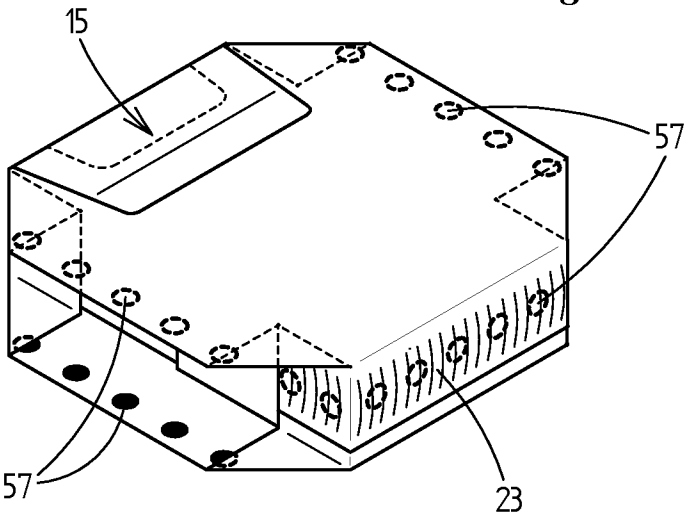
FIG. 15 shows a third step when encasing a group in a blank.
Figure 13:
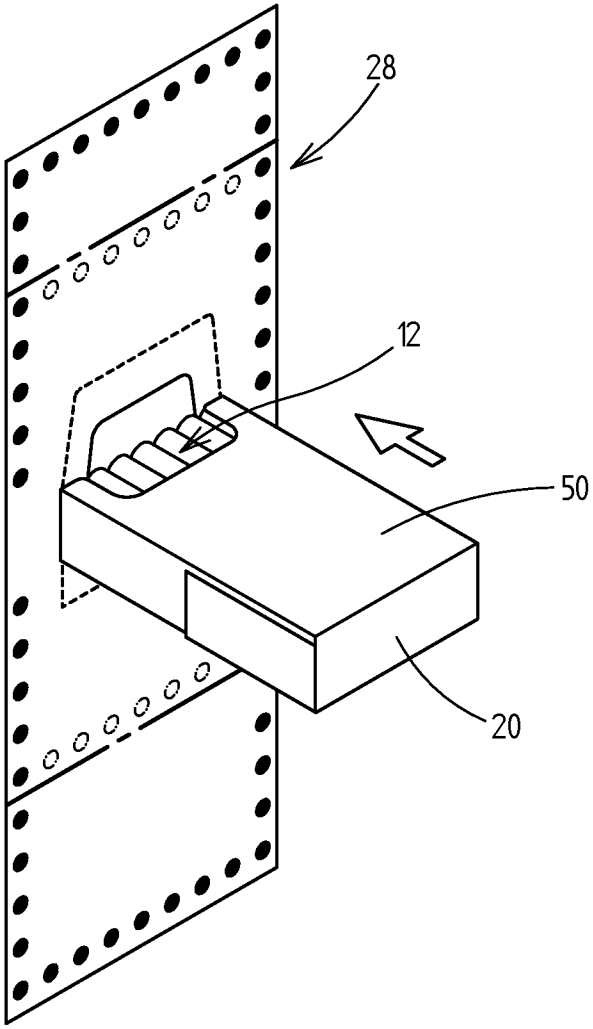
FIG. 13 shows a first step when encasing a group in a blank.

FIG. 13 shows a first step of the packaging method, wherein the blank 28 shown indicate the glue connections for the version according to FIG. 11 and according to FIG. 12. Here, the tray 50 having the group 12 is wrapped into the blank 28 by way of the end side 19 leading, and the blank 28 is wrapped around the group 12 in the longitudinal direction of the latter. FIG. 14 shows the configuration of the seam 23 as a fin seam which is then folded into the base side 20 (FIG. 15). Thereafter, the folding tabs are folded in the region of the narrow sides 19 and the seams 23 are formed in said region.

FIGS. 11 to 15 in an identical manner show the use of glue which in form of glue points 57 is applied to the folding tab, or to the periphery of the blank 28, respectively. It is understood that all other variants of the materially integral connection described in the application can also be used, for example also a sealing varnish.

Figure 17:
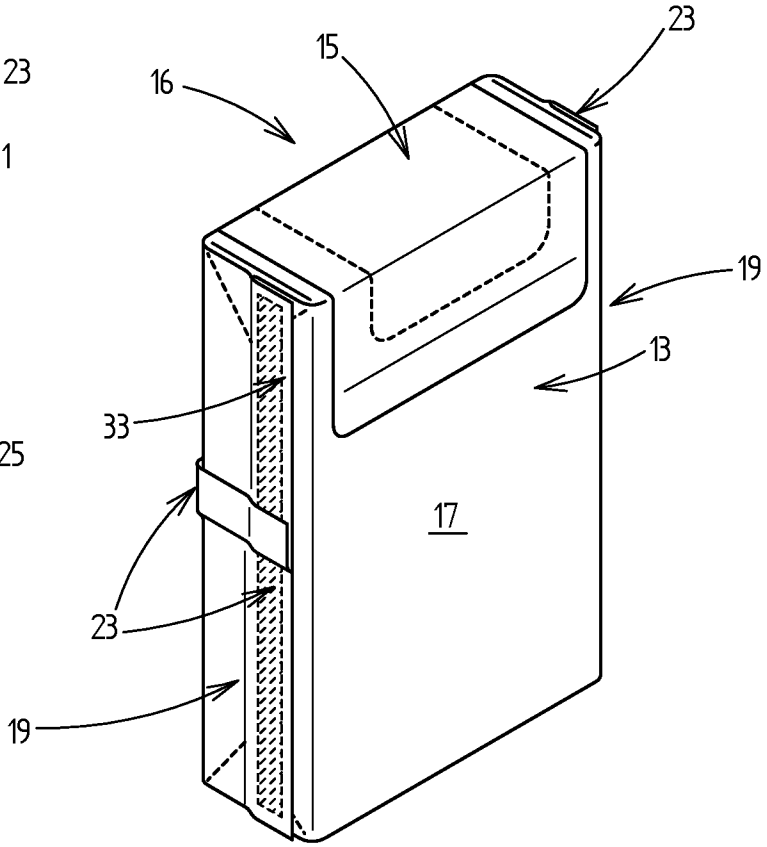
FIG. 17 shows a group of cigarettes in a fourth casing.
Figure 16:
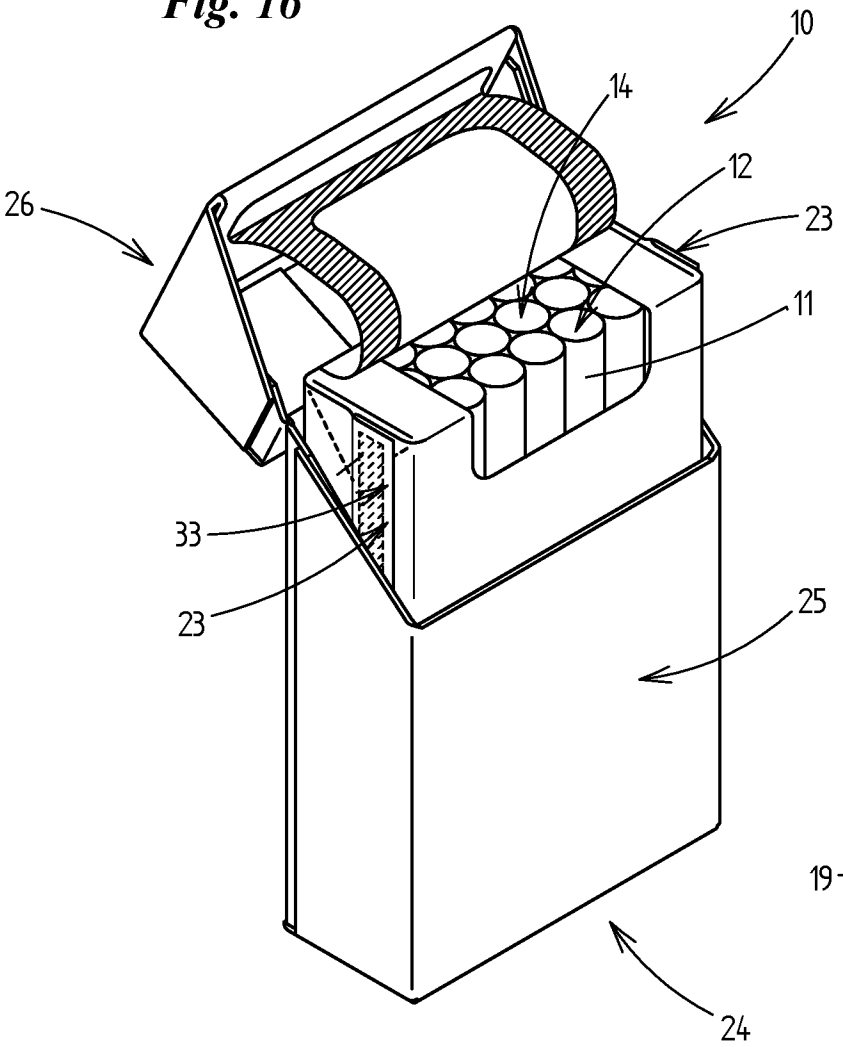
FIG. 16 shows a third packet for cigarettes, having an opened lid.

FIGS. 16 and 17 show a variant of the packet 10 or casing 13, respectively, shown in FIGS. 1 and 2. It is initially obvious that the collar 27 shown in the exemplary embodiment according to FIGS. 1 and 2 is absent in the exemplary embodiment shown in FIGS. 16 and 17.

The omission of the collar 27 can take place for reasons of sustainability, for example, in that the material consumption in the production of the packets 10 is reduced. Of course, this also leads to a reduction in the production costs of the packet 10.

A problematic aspect in the omission of a collar 27 is the closing procedure of the lid 26. The applicant has recognized that it may arise during the closing of the lid 26 that the lateral walls of the lid 26 collide with the turned-back seams 23 of the casing 13 when said seams 23 are not retained by a collar 27 on the narrow sides 19 of the casing 13.

In order for this problem to be solved, it is proposed to turn back the seams 23 in the region of the narrow sides 19 of the casing 13 in the direction of the front side 17, and to connect said seams 23 to the narrow sides 19 of the casing 13 before the casing 13 is introduced into a packet 10. It is achieved as a result that the lateral walls of the lid 26 can slide past the seams 23 of the casing 13 in the region of the narrow sides 19 when closing the lid 26. The connection between the seams 23 and the casing 13 can serve for overcoming the restoring forces of the turned-back seams 23. A hot-melt glue application 33 (hot glue track or glue point) be used to this end, for example.

Summarizing, it is to be set forth that a paper-based material web 39 is used in all variants. Said material web 39 on the external side can be provided with an aluminum layer such that a material web 39 from a paper/aluminum laminate is processed instead of a pure paper web. It is also conceivable that a material web 39 from a metallized paper is used, thus a paper web having a vapor-deposited metal layer. The material web 39 can be coated in the process, or else be supplied in a pre-coated form. This also applies to the other coatings, for example having a sealing varnish. The latter can be applied (partially or on the full area), specifically either in the packaging process or prior thereto.

Should the use of a paper-based material web 39 not be desired or required, the following material webs 39 could also be used, for example:

- triplex composite film having a (white) OPP ply, an aluminum ply and a PET ply;
- triplex composite film having a PP ply, an aluminum ply and a PET ply;
- triplex composite film having a (white printed) OPP ply, an aluminum ply and a PET ply;
- duplex composite film having a (white or printed) PP ply and a metallized PET ply.

The films as well as the material web 39 can preferably be white on that side that points toward the packet content (thus on the internal side). This may be the result of the use of a corresponding material or by a corresponding application of paint.

LIST OF REFERENCE SIGNS

10 Packet
11 Cigarette
12 Group
13 Casing
14 Retrieval opening
15 Closure means
16 Inner packet
17 Front side
18 Rear side
19 Narrow side
20 Base side
21 End side
22 Folding tab

23 Seam
24 Outer packet
25 Box part
26 Lid
27 Collar
28 Blank
29 Fold line
30 Folding tab (transverse seam)
31 Folding tab (longitudinal seam)
32 Cold glue
33 Hot glue
34 Sealing varnish
35 Imprint
36 Ventilation flap
37 Silicone coating
38 Bobbin
39 Material web
40 Splicer
41 Pendulum accumulator
42 Web edge control
43 Printing unit
44 Printing unit
45 Drying unit
46 Advancing roller
47 Labelling apparatus
48 Punching apparatus
49 Forming shoulder
50 Tray
51 Arrow
52 Contact pressure or sealing tool, respectively
53 Tool
54 Contact pressure element
55 Gluing apparatus
56 Gluing apparatus
57 Glue spot
58 Roller
59 Separating blade
60 Counterpart
61 Counter roller
62 Transverse contact pressure element or transverse sealing element, respectively

The invention claimed is:

1. A packet for cigarette industry products, having a casing (13) which at least partially surrounds a group (12) of cigarette industry products as the packet content, wherein the casing (13) is formed from a packaging material, and wherein folding tabs (30, 31) of the packaging material are connected to one another by seams (23), the casing (13) is formed from a paper-based packaging material, the casing (13) has a large-area front side (17), a corresponding, opposite, large-area rear side (18), narrow sides (19) that connect the front side (17) and the rear side (18) to one another, as well as a base side (20) and an opposite end side (21), wherein the base side (20) and the end side (21) are in each case adjacent to the front side (17), the rear side (18) and the narrow sides (19), the folding tabs (30, 31) of the paper-based packaging material in the region of the seams (23) are connected to one another in a materially integral manner, the packaging material has a paper base having a grammage of 30 to 140 g/m$^2$, the paper-based packaging material has a unilateral coating (32, 33, 34) having a material for connecting the folding tabs (30, 31) in a materially integral manner in the region of the seams (23), and the seams (23) include longitudinal seams, which run so as to be directed parallel to the longitudinal axis of the casing (13), and transverse seams, which run so as to be directed transversely to the longitudinal axis of the casing (13).

2. The packet as claimed in claim 1, wherein the group (12) of products is disposed in a tray (50) of packaging material, and in that the casing (13) at least partially surrounds the group (12) of products and the tray (50).

3. The packet as claimed in claim 1, wherein the casing (13) has a retrieval opening (14), able to be closed by a closure means (15) that is able to be activated multiple times, wherein the closure means (15) is paper-based.

4. The packet as claimed in claim 3, wherein the paper-based closure means (15) extends across an end side (21) of the casing (13) and substantially completely covers the end side (21).

5. The packet as claimed in claim 1, wherein the coating (32, 33, 34) is provided only in the region of the folding tabs (30, 31) to be connected.

6. The packet as claimed in claim 1, wherein the coating (32, 33, 34) is formed from one or a plurality of the following materials:

hot-melt glue;

cold glue or a dispersion adhesive, respectively;

PSA; and sealing varnish, namely a polymer-based sealing varnish.

7. The packet as claimed in claim 1, wherein the seams (23) of the casing (13) from a paper-based packaging material are configured as fin seams.

8. The packet as claimed in claim 1, wherein the seams (23) are folded toward neighboring lateral faces (19, 20) of the casing (13) and thereon are fastened to the casing (13) by adhesive bonding.

9. The packet as claimed in claim 8, wherein the longitudinal seams (23) in the region of narrow sides (19) of the casing (13) are folded in the direction of a front side (17) or a rear side (18) of the casing (13).

10. The packet as claimed in claim 9, wherein in casings (13) in which the seams (23) that are folded in the direction of the front side (17), the packet (10) in the region of narrow sides (19) of the casing (13) does not have any collar (27), and the folded seams (23) are fastened to the casing (13) by adhesive bonding so as to avoid any collision between a lid (26) of the packet (10) and the folded seams (23) when closing the lid (26).

11. The packet as claimed in claim 1, wherein the packaging material on a side that faces away from the packet content has a coating as a vapor barrier, namely a coating from a wax-type material, from aluminum, or a vapor-deposited metal.

12. The packet as claimed in claim 1, wherein the group (12) is disposed in a tray (50), wherein the casing (13), namely in the region of the retrieval opening (14), only partially encases the group (12) having the tray (50), and wherein the region of the group (12) not encased by the casing (13) is encased across the full area by the tray (50).

13. The packet as claimed in claim 2, wherein the casing (13) is connected to the tray (50) in a materially integral manner, namely in the transition between a lower end of the casing (13).

14. The packet as claimed in claim 1, wherein the seams (23) in the region of the narrow sides (19) are configured as an envelope fold, wherein the mutually overlapping folding tabs (30, 31) of the packaging material in the region of the seams (23) are connected to one another in a materially integral manner.

15. The packet as claimed in claim 1, wherein the seams (23) in the region of the narrow sides (19) are configured as an envelope fold, and the seams (23) in the region of the front side (17), the rear side (18) and the base side (20) are configured as a fin seam.

16. The packet as claimed in claim 1, wherein the packaging material has a paper base having a gram mage of 30 to 90 g/m$^2$.

17. The packet as claimed in claim 1, wherein the packaging material has a paper base having a gram mage of 30 to 70 g/m$^2$.

18. A packet for cigarette industry products, having a casing (13) which at least partially surrounds a group (12) of cigarette industry products as the packet content, wherein the casing (13) is formed from a packaging material, and wherein folding tabs (30, 31) of the packaging material are connected to one another by seams (23), the casing (13) is formed from a paper-based packaging material, the casing (13) has a large-area front side (17), a corresponding, opposite, large-area rear side (18), narrow sides (19) that connect the front side (17) and the rear side (18) to one another, as well as a base side (20) and an opposite end side (21), wherein the base side (20) and the end side (21) are in each case adjacent to the front side (17), the rear side (18) and the narrow sides (19)

the folding tabs (30, 31) of the paper-based packaging material in the region of the seams (23) are connected to one another in a materially integral manner, the paper-based packaging material has a unilateral coating (32, 33, 34) having a material for connecting the folding tabs (30, 31) in a materially integral manner in the region of the seams (33), the coating (32, 33, 34) is provided only in the region of the folding tabs (30, 31) to be connected, and the seams (23) include longitudinal seams, which run so as to be directed parallel to the longitudinal axis of the casing (13), and transverse seams, which run so as to be directed transversely to the longitudinal axis of the casing (13).

19. The packet as claimed in claim 18, wherein the packaging material has a paper base having a grammage of 30 to 140 g/m$^2$.

20. The packet as claimed in claim 18, wherein the packaging material has a paper base having a gram mage of 30 to 90 g/m$^2$.

21. The packet as claimed in claim 18, wherein the packaging material has a paper base having a gram mage of 30 to 70 g/m$^2$.

22. The packet as claimed in claim 18, wherein the casing (13) has a retrieval opening (14), able to be closed by a closure means (15) that is able to be activated multiple times, wherein the closure means (15) is paper-based.

23. The packet as claimed in claim 22, wherein the paper-based closure means (15) extends across an end side (21) of the casing (13) and substantially completely covers the end side (21).

24. A packet for cigarette industry products, having a casing (13) which at least partially surrounds a group (12) of cigarette industry products as the packet content, wherein the casing (13) is formed from a packaging material, and wherein folding tabs (30, 31) of the packaging material are connected to one another by seams (23), and wherein the casing (13) is formed from a paper-based packaging material, wherein the casing (13) has a large-area front side (17), a corresponding, opposite, large-area rear side (18), narrow sides (19) that connect the front side (17) and the rear side (18) to one another, as well as a base side (20) and an opposite end side (21), wherein the base side (20) and the end side (21) are in each case adjacent to the front side (17), the rear side (18) and the narrow sides (19), the folding tabs (30, 31) of the paper-based packaging material in the region of the seams (23) are connected to one another in a materially integral manner, the packaging material has a paper base having a grammage of 30 to 140 g/m$^2$, the paper-based packaging material has a unilateral coating (32, 33, 34) having a material for connecting the folding tabs (30, 31) in a materially integral manner in the region of the seams (23), the coating (32, 33, 34) is provided only in the region of the folding tabs (30, 31) to be connected, the coating (32, 33, 34) is formed from one or a plurality of the following materials:

hot-melt glue;

cold glue or a dispersion adhesive, respectively;

PSA; and sealing varnish, namely a polymer-based sealing varnish, and the seams (23) include longitudinal seams, which run so as to be directed parallel to the longitudinal axis of the casing (13), and transverse seams, which run so as to be directed transversely to the longitudinal axis of the casing (13).

25. The packet as claimed in claim 24, wherein the packaging material has a paper base having a grammage of 30 to 90 g/m$^2$.

26. The packet as claimed in claim 24, wherein the packaging material has a paper base having a grammage of 30 to 70 g/m$^2$.

27. The packet as claimed in claim 24, wherein the casing (13) has a retrieval opening (14), able to be closed by a closure means (15) that is able to be activated multiple times, wherein the closure means (15) is paper-based.

28. The packet as claimed in claim 27, wherein the paper-based closure means (15) extends across an end side (21) of the casing (13) and substantially completely covers the end side (21).

* * * * *